US008012049B1

(12) United States Patent
Walterscheid

(10) Patent No.: US 8,012,049 B1
(45) Date of Patent: Sep. 6, 2011

(54) NOVELTY DART WITH FOAM SUCTION CUP

(76) Inventor: Steve Walterscheid, Bend, OR (US)

( * ) Notice: Subject to any disclaimer, the term of this patent is extended or adjusted under 35 U.S.C. 154(b) by 425 days.

(21) Appl. No.: 12/167,223

(22) Filed: Jul. 2, 2008

(51) Int. Cl.
*A63B 65/02* (2006.01)

(52) U.S. Cl. ..... 473/578; 473/572

(58) Field of Classification Search ..... 473/572, 473/578

See application file for complete search history.

(56) References Cited

U.S. PATENT DOCUMENTS 1,774,765 A * 9/1930 Schoen ..... 473/572
3,378,260 A * 4/1968 Hartel ..... 273/412
3,855,991 A * 12/1974 Imatt et al. ..... 124/24.1
4,030,761 A * 6/1977 Daller ..... 473/572
5,964,437 A * 10/1999 Belokin et al. ..... 248/205.5

* cited by examiner

*Primary Examiner* — John Ricci
(74) *Attorney, Agent, or Firm* — LaMorte & Associates, P.C.

(57) ABSTRACT

A projectile device having a suction cup head made of a novel foam. The foam used in the suction cup head has an open cell density within the foam of between five percent and twenty percent. The suction cup head has a face surface of a first diameter. A shallow concavity is formed in the face surface. The concavity has nearly the same diameter as the face surface, however, the depth of the concavity is no more than one-tenth of that diameter. Furthermore, the face surface of the suction cup head is proportionally large, being at least twenty-five percent as wide as the entire projectile device is long. The combination of a large suction cup head, a shallow concavity and a soft, semiporous foam enables the suction cup head to adhere to both smooth surfaces and rough surfaces.

19 Claims, 5 Drawing Sheets

NOVELTY DART WITH FOAM SUCTION CUP

BACKGROUND OF THE INVENTION

1. Field of the Invention

In general, the present invention relates to novelty darts and similar projectiles that are tipped with a suction cup. More particularly, the present invention relates to the structure of such novelty darts and the materials used in the formation of the suction cup.

2. Description of the Prior Art

Rubber suction cups were first used on the tip of projectile toys at the beginning of the $20^{th}$ century. Toy darts and toy arrows tipped with a suction cup have unique advantages. A dart tipped with a suction cup is relatively safe, being unlikely to cause damage to any person or object it strikes. The suction cup acts as a large blunt rubber tip. However, unlike other blunt tip configurations, a toy dart or arrow with a suction cup has the ability to stick to a smooth flat surface. Darts and arrows with suction cup tips, therefore, have more play value than similar toy darts and arrows that have simple blunt tips.

In early toys, suction cups were structures of rubber having a concave face. In later years, synthetic rubber and other elastomeric materials, such as silicone, were used. When the face of the suction cup struck a hard, flat object, the concave face of the suction cup would partially flatten and the rubber would seal against the impacted surface. The pressure inside the suction cup would, therefore, be lower than the air pressure surrounding the suction cup and the suction cup would adhere to the impacted surface. As air leaked back into the suction cup, it would detach from the impacted surface.

Traditional suction cups made from elastomeric materials work well if they squarely impact a hard, flat surface, such as a window pain or the metal door of a refrigerator. However, traditional suction cups work very poorly on semi-smooth surfaces such as painted walls and rough surfaces, such as concrete walls. When a traditional suction cup impacts a non-smooth surface, such as a painted wall, the elastomeric material cannot create an air tight seal around the perimeter of the suction cup. Therefore, the suction cup either fails to adhere to the surface or only adheres for a second or two before falling away.

In order to make traditional suction cups more effective on semi-smooth surfaces, children often wet the suction cup. However, wet suction cups quickly become dirty as the moisture on the suction cup attracts dirt and grime. Dirty suction cups then create circular stains on impacted surfaces, such as ceilings and walls. This common scenario has caused suction cup toys to lose favor with many parents who want to keep the surfaces of their home stain free.

In modern toy design, some projectiles are made completely out of foam. Such projectiles are commonly used by Hasbro, Inc, of Rhode Island in their Nerf® line of toys. Foam projectiles are extremely lightweight and are therefore very unlikely to cause injury. However, due to their light weight, such prior art foam projectiles do not travel far. Furthermore, prior art projectiles that have suction cups made of foam use a completely closed cell foam. Closed cell foams were believed to be the only type of foam that could be used in forming a suction cup because it is the only foam that is air impervious and capable of maintaining suction.

The main disadvantage of using a closed cell foam is that such foams tend to be stiff. Suction cups made of such foams, therefore do not deform much on impact and thus create poor surface seals. Consequently, projectiles with foam suction cups rarely adhere to any surface, unless the surface is ultra-smooth, such as a sheet of glass.

A need therefore exists for a suction cup configuration that is safe when impacting a child, yet is capable of adhering to semi-smooth and rough surfaces, such as walls, without having to be wet. This need is met by the present invention as described and claimed below.

SUMMARY OF THE INVENTION

The present invention is a novelty projectile device having a suction cup head made of a novel foam. The foam used in the suction cup head has an open cell density within the foam of between five percent and twenty percent. To optimize the ability of the semiporous foam suction cup head to adhere to both smooth and rough surfaces, the suction cup head is provided with unique structural features. The suction cup head has a face surface of a first diameter. A shallow concavity is formed in the face surface. The concavity has nearly the same diameter as the face surface, however, the depth of the concavity is no more than one-tenth of that diameter. Furthermore, the face surface of the suction cup head is proportionally very large, being at least twenty-five percent as wide as the entire novelty projectile device is long. The combination of a large suction cup head, a shallow concavity and a soft, semiporous foam enables the suction cup head to adhere to both smooth surfaces and rough surfaces.

The novelty projectile device also contains body features that ensure that the projectile device flies straight when thrown so that the face surface of the suction cup head creates good adhesion upon impact.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention can be configured as many types of toy projectiles, such as a toy arrow or a toy dart gun projectile, the present invention is especially well suited for use as a large, hand-thrown projectile. Accordingly, the present invention is illustrated and described as a hand-thrown projectile in order to set forth the best mode contemplated for the invention. However, the illustrated embodiment is only intended to be exemplary and should not be considered a limitation upon other possible embodiments of the invention contained within the scope of the claims.

Figure 1:
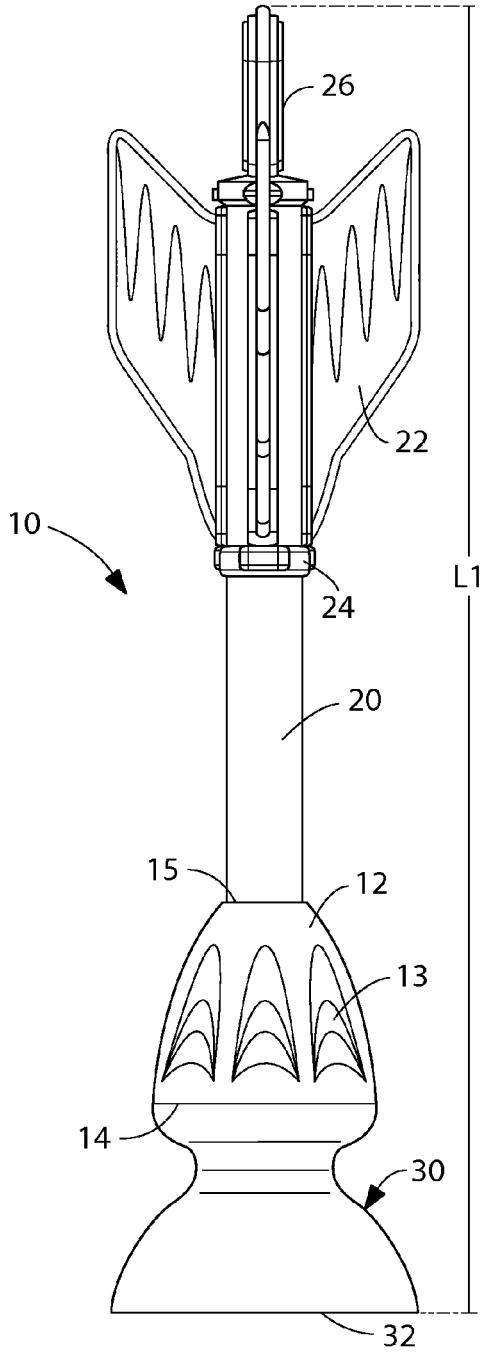
FIG. 1 is a front view of an exemplary embodiment of a hand-thrown projectile.
Figure 2:
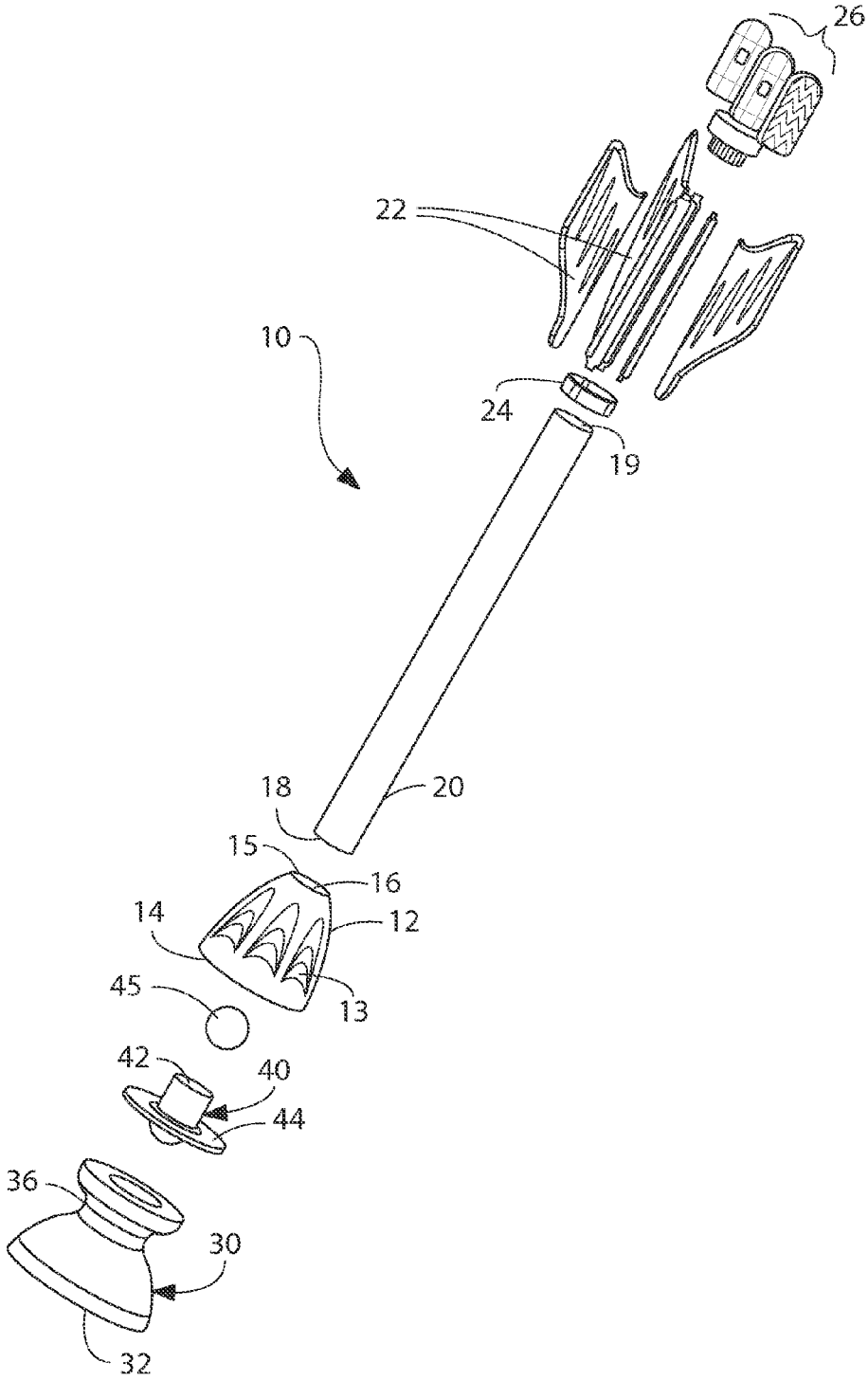
FIG. 2 is an exploded perspective view of the embodiment of FIG. 1.
Figure 3:
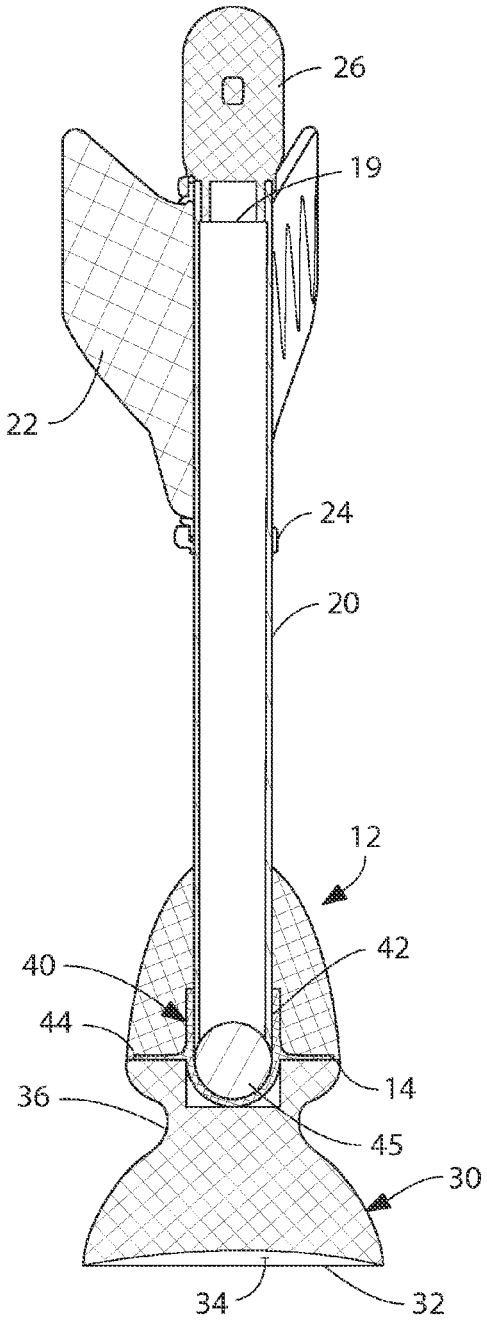
FIG. 3 is a cross-sectional view of the embodiment of FIG. 1.

Referring to FIG. 1 in conjunction with both FIG. 2 and FIG. 3, an exemplary hand-thrown toy projectile 10 is shown. The hand-thrown toy projectile 10 is configured as a large dart toy, having a preferred overall body length L1 of between eight and fourteen inches.

The toy projectile 10 includes a bulbous housing 12. The bulbous housing 12 has a front end 14 and an opposite back end 15. The bulbous housing 12 is shaped generally like a half football so that it can be easily gripped and thrown. The bulbous housing 12 may also have depressions 13 on its exterior surface to improve the ability of a child to grasp the bulbous housing 12.

A bulbous housing 12 is annular in it construction, therein defining an internal conduit 16 that passes through the center of the bulbous housing 12 from its front end 14 to its back end 15.

A shaft 20 extends into the conduit 16 of the bulbous housing 12 from the back end 15 of the bulbous housing 12. The shaft 20 has a first end 18 and an opposite second end 19. The first end 18 of the shaft 20 passes into the bulbous housing 12 and is affixed in place.

A plurality of stabilizing fins 22 are provided. The stabilizing fins 22 attach to the shaft 20 so that the fins 22 radially extend from the shaft 20 proximate the second end 19 of the shaft 20. The stabilizing fins 22 are held in place with adhesive and/or heat bonding. A collar 24 is also provided to engage the front ends of the stabilizing fins 22 and help prevent the stabilizing fins 22 from impact damage.

An optional toss lever 26 may extend from the second end 19 of the shaft 20 behind the stabilizing fins 22. The toss lever 26 is a short tab of plastic that enables the toy projectile 10 to be grabbed and tossed in the manner of a horseshoe.

A novel suction cup head 30 is provided. The suction cup head 30 has a wide, round face surface 32. The shaft 20 and the stabilizing fins 22 cause the face surface 32 of the suction cup head 30 to face forward when the toy projectile 10 is thrown through the air. Consequently, the face surface 32 of the suction cup head 30 is the surface that first contacts an object when the toy projectile 10 is thrown against that object.

The face surface 32 of the suction cup head 30 has a diameter that is at least twenty-five percent (25%) as wide as the entire length L1 of the toy projectile 10. This wide front proportion is important to the functionality of the toy projectile 10, as will later be explained.

A concavity 34 is formed in the face surface 32 of the suction cup head 30. The concavity 34 preferably has a radius of curvature greater than the diameter of the face surface 32. Furthermore, the concavity 34 is shallow and extends below the face surface 32 of the suction cup head 30 a depth that is no more than ten percent (10%) of the maximum diameter of the face surface 32. The shallowness of the concavity 34 is also important to the functionality of the toy projectile 10, as will later be explained.

The suction cup head 30 tapers down in diameter from the face surface 32 to a reduced neck 36. The diameter of the reduced neck 36 is no greater than fifty percent (50%) of the diameter of the face surface 32. The suction cup head 30 then expands again to the diameter of the front end 14 of the bulbous housing 12. The reduced neck 36 acts as a universal joint for the suction cup head 30. If the suction cup head 30 impacts an object at an angle, the suction cup head 30 can easily bend at the reduced neck 36. This enables the face surface 32 of the suction cup head 30 to adjust to the angle of impact and make flush contact with the object being struck.

The suction cup head 30 is made of a unique foam composition that creates a semiporous foam rubber with an open cell density of between 5% and 20%. The preferred composition for the foam material, is as follows:

35%-45% Polyethylene-vinyl
10%-20% Ethylene-Vinyl Acetate (EVA)
10%-20% Butadiene Rubber
5%-15% Polyethylene (high density)
15%-25% Calcium Carbonate This foam composition is lightweight, soft, highly flexible and only slightly permeable to air. These characteristics are important to the functionality of the suction cup head 30, as is later described.

The suction cup head 30 is affixed to the bulbous housing 12 via a cup structure 40. The cup structure 40 has a central cup chamber 42 and a wide flange 44 that radially extends outwardly away from the central cup chamber 42. The wide flange 44 is disposed between the suction cup head 30 and the bulbous housing 12, therein providing a large stable surface to which both pieces can be adhered.

A weight 45 is placed inside the cup structure 40. The size of the weight 45 depends upon the weights of the various components and materials used in the manufacture of the toy projectile 10. It is preferred that the toy projectile 10 has a center of gravity positioned at or near the transition between the bulbous housing 12 and the suction cup head 30. This center of gravity helps the toy projectile 10 fly straight when thrown. By placing the weight 45 in the cup structure 40, this center of gravity can be maintained, even if the weight of the suction cup head 30 and the stabilizer fins 22 vary from piece to piece.

Figure 4:
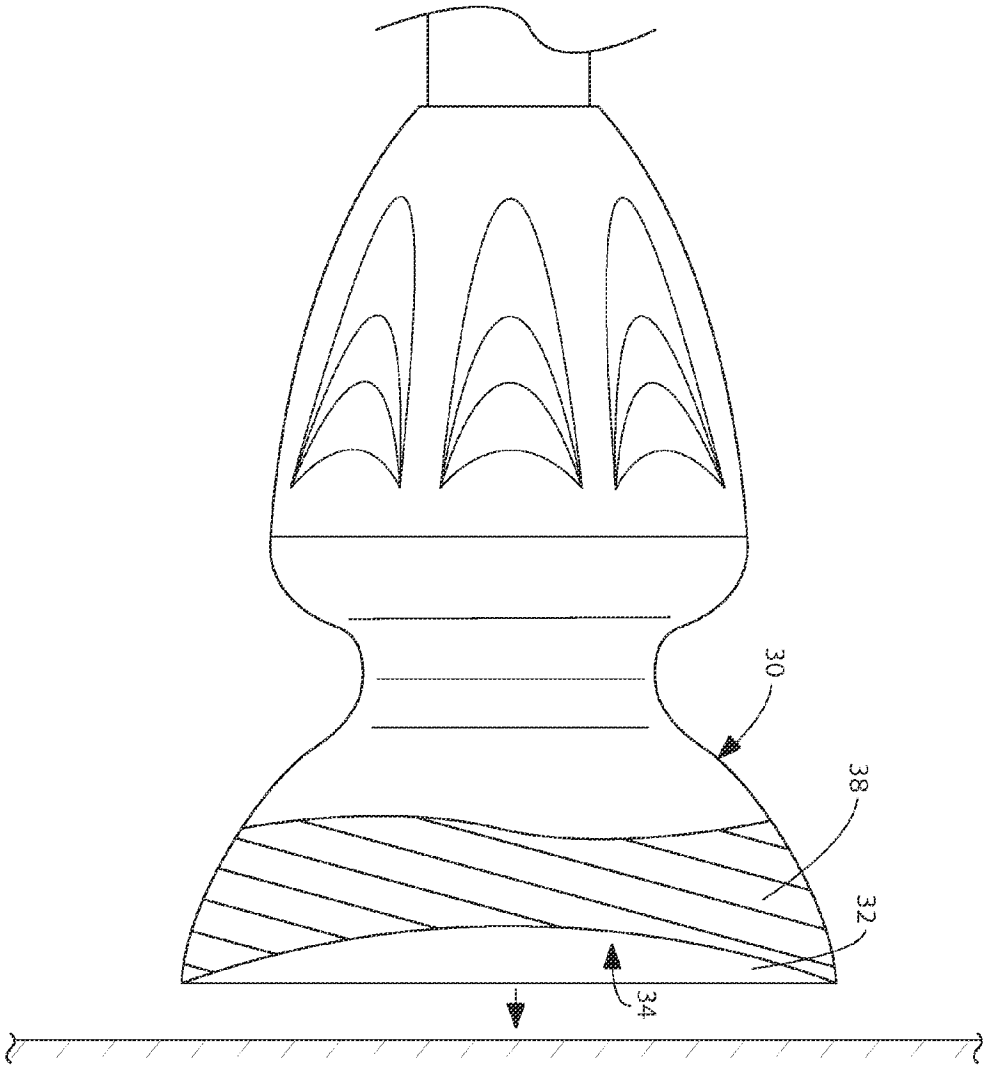
FIG. 4 is a cross-sectional view of the suction cup head of the exemplary hand-thrown projectile shown just prior to impact.
Figure 5:
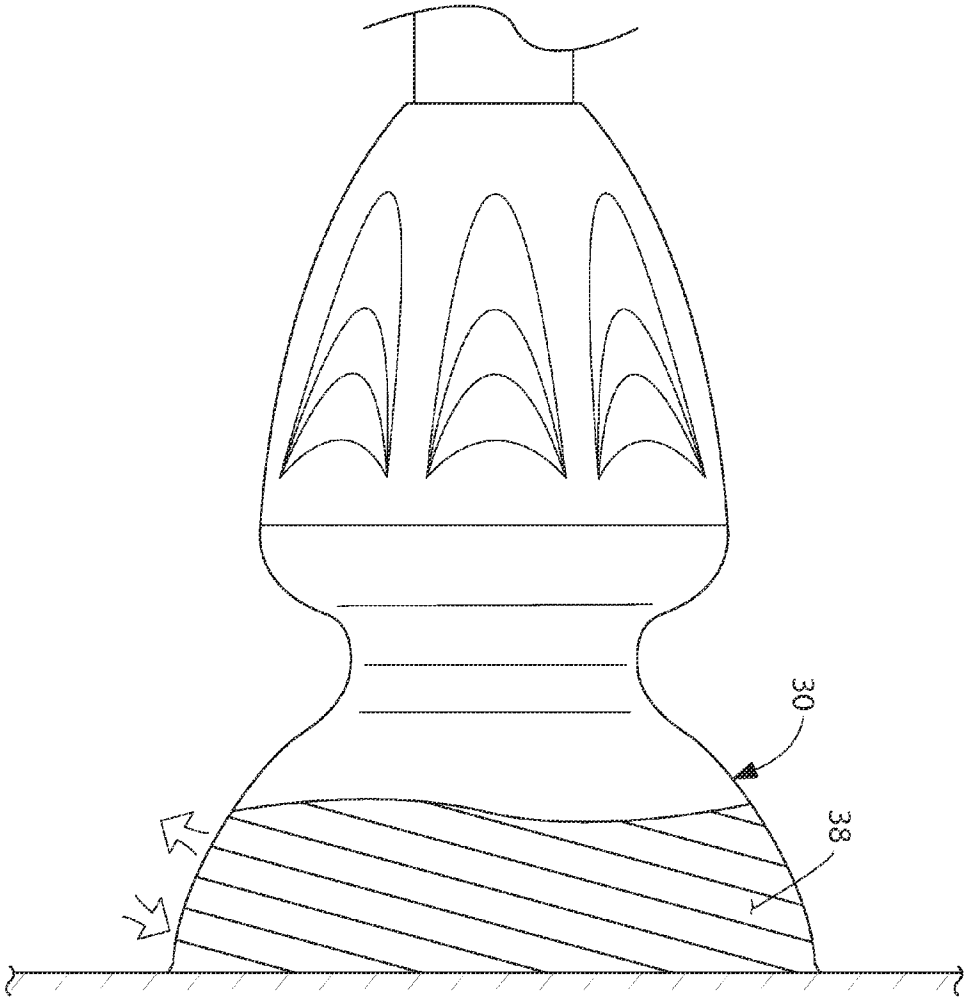
FIG. 5 is a cross-sectional view of the suction cup head of the exemplary hand-thrown projectile shown just after impact.

Referring now to FIG. 4 in conjunction with FIG. 5, it can be seen that when the suction cup head 30 impacts a flat surface, the foam material 38 of the suction cup head 30 compresses. The shallow concavity 34 in the face surface 32 of the suction cup head 30 collapses completely. Air that used to be in the concavity 34 either escapes past the periphery of the concavity or passes into the semiporous foam material 38. Since the foam material 38 is compressed upon impact, air present in the foam material 38 is forced out of the foam material 38 and into the surrounding environment. Due to the softness of the foam material 38, the foam material 38 conforms to the impacted surface and envelopes any imperfections that may be present on the impacted surface. The face surface 32 of the suction cup head 30, therefore, conforms to a rough surface just as well as it would a smooth surface.

A fraction of a second after impact, the energy of the impact is fully dissipated and the suction cup head 30 begins to expand back into its original shape. In order for the suction cup head 30 to return to its original shape, air must pass through the foam material 38 in an amount sufficient enough to fill the reforming concavity 34. The foam material 38 is only partially porous. Furthermore, the few open cells in the foam material 38 are compressed. Consequently, it takes a few seconds for enough air to pass into the foam material 38 to reform the concavity 34. Until the concavity 34 reforms, the air pressure inside the reforming concavity 34 is less than ambient pressure. This pressure differential is slight but is sufficient enough to support the full weight of the toy projectile 10. By providing a face surface 32 on the suction cup head 30 that is oversized, the adhesion force created by the pressure differential can be increased to support the weight of the toy projectile 10 for longer periods of time.

It will therefore be understood that when the toy projectile 10 is thrown toward an object, the face surface 32 of the suction cup head 30 will be the first part of the toy projectile 10 to strike the object. During impact, the shallow concavity 34 on the face surface collapses. Furthermore, the foam material 38 of the suction cup head 30 compresses. The foam material 38 conforms to the imperfections of the impacted surface. Air pressure holds the toy projectile 10 in place. After a few moments, enough air flows through the foam material 38 to enable the shallow concavity 34 to reform. At this point, the air pressure differential fades to zero and the toy projectile 10 falls away from the impacted surface.

In a practical example, a child holding the exemplary embodiment of the toy projectile 10 can through the toy projectile 10 against almost any wall. Regardless of the roughness or smoothness of the wall, the toy projectile 10 will adhere to the wall for a few moments and will then fall away.

It will be understood that the embodiment of the present invention that is illustrated and described is merely exemplary and that a person skilled in the art can make many alternate embodiments. For example, the toy projectile 10 can have a longer shaft so it can be used as an arrow. Alternatively, the toy projectile 10 can be made without stabilizing fins so that it can be shot from a dart gun. Furthermore, features such as the shape of the bulbous housing, the shape of the stabilizing fins are a matter of design choice. All such variations, modifications and alternate embodiments are intended to be included within the scope of the present invention as defined by the claims.

What is claimed is:

1. A novelty projectile device, comprising:

a suction cup head having a face surface of a first diameter and a concavity in said face surface, wherein said suction cup head is comprised of a synthetic foam composition having an open cell concentration of between five percent and twenty percent; and a shaft for stabilizing said novelty projectile in flight so that said face surface of said suction cup head leads while said projectile device is in flight.

2. The device according to claim 1, wherein said foam composition contains a mixture of polyethylene-vinyl, ethylene-vinyl acetate, butadiene rubber and high-density polyethylene.

3. The device according to claim 2, wherein said foam composition contains calcium carbonate.

4. The device according to claim 1, wherein said concavity in said suction cup head has a maximum depth no greater than one-tenth of said first diameter of said face surface.

5. The device according to claim 1, wherein said suction cup head has a back surface opposite said face surface, wherein said suction cup head tapers from said face surface down to a restricted neck and expands from said restricted neck out to said back surface.

6. The device according to claim 5, wherein said restricted neck has a diameter no greater than half of said first diameter of said face surface.

7. The device according to claim 1, further including a metal weight disposed between said suction cup head and said shaft.

8. The device according to claim 1, further including a housing that covers at least part of said shaft to provide an enlarged area to grip and throw said projectile device.

9. The device according to claim 1, further including stabilizer fins affixed to said shaft.

10. The device according to claim 9, further including a tab extension extending from said shaft behind said stabilizer fins.

11. A projectile device comprising:

a foam suction cup head having a face surface of a first diameter and a concavity in said face surface having a maximum depth no greater than one-tenth that of said first diameter, wherein said foam suction cup head has an open cell density of between five percent and twenty percent; and a shaft extending behind said foam suction cup head, wherein said shaft and said foam suction cup head provide said projectile device with an overall length, and wherein said first diameter is no less than thirty percent of said overall length.

12. The device according to claim 11, wherein said suction cup head has a back surface opposite said face surface, wherein said suction cup head tapers from said face surface down to a restricted neck and expands from said restricted neck out to said back surface.

13. The device according to claim 12, wherein said restricted neck has a diameter no greater than half of said first diameter of said face surface.

14. The device according to claim 11, further including a metal weight disposed between said suction cup head and said shaft.

15. The device according to claim 11, further including a housing that covers at least part of said shaft to provide an enlarged area to grip and throw said projectile device.

16. The device according to claim 11, further including stabilizer fins affixed to said shaft.

17. A suction cup head for a projectile, comprising:

a face surface;

a back surface;

a concavity disposed in said face surface;

wherein said suction cup head is fabricated from foam containing a mixture of polyethylene-vinyl, ethylene-vinyl acetate, butadiene rubber, high-density polyethylene and calcium carbonate.

18. The device according to claim 17, wherein said suction cup head tapers from said face surface down to a restricted neck and expands from said restricted neck out to said back surface.

19. The device according to claim 18, wherein said restricted neck has a diameter no greater than half of said face surface.

* * * * *